US007759867B2

(12) United States Patent
Kim et al.

(10) Patent No.: US 7,759,867 B2
(45) Date of Patent: Jul. 20, 2010

(54) DISPLAY PANEL ELECTRODE HAVING A PROTRUSION

(75) Inventors: Se-Jong Kim, Asan-si (KR); Seok-Gyun Woo, Asan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 11/858,724

(22) Filed: Sep. 20, 2007

(65) Prior Publication Data

US 2008/0048564 A1 Feb. 28, 2008

Related U.S. Application Data

(63) Continuation of application No. 10/942,049, filed on Sep. 16, 2004, now Pat. No. 7,288,891.

(30) Foreign Application Priority Data

Sep. 25, 2003 (KR) ..... 10-2003-066507

(51) Int. Cl.
*H01J 61/00* (2006.01)
*H01J 17/00* (2006.01)
*H01J 17/49* (2006.01)

(52) U.S. Cl. ..... 313/584; 313/567; 313/581; 313/582; 313/583; 313/585; 313/586

(58) Field of Classification Search ..... None
See application file for complete search history.

(56) References Cited

U.S. PATENT DOCUMENTS 6,157,128 A * 12/2000 Namiki et al. ..... 313/581
6,498,430 B1 12/2002 Sakai et al.
6,549,180 B1 4/2003 Yoo et al.
6,630,788 B1 10/2003 Park
6,657,396 B2 12/2003 Nakada et al.
6,720,736 B2 4/2004 Lee et al.
6,747,414 B2 * 6/2004 Yoshida ..... 313/581

(Continued)

FOREIGN PATENT DOCUMENTS

JP 2002343257 A * 11/2002

(Continued)

OTHER PUBLICATIONS

English translation of JP 2002-343257 (Miyazaki et al.).*

(Continued)

*Primary Examiner*—Nimeshkumar D Patel
*Assistant Examiner*—Natalie K Walford
(74) *Attorney, Agent, or Firm*—H.C. Park & Associates, PLC

(57) ABSTRACT

A plasma display panel is provided. The plasma display panel comprises a plurality of first electrodes and a plurality of second electrodes; wherein the first electrodes and the second electrodes cross at a discharge space; wherein prominent electrodes and formed at a portion o the first electrodes where the first electrodes cross with the second electrodes to extend the area of the address electrodes so that a stable address discharge may occur, and vertical centers of the prominent electrodes are asymmetrical with respect to vertical centers of the discharge spaces, which may be coated with red, green and blue fluorescent layers.

10 Claims, 7 Drawing Sheets

U.S. PATENT DOCUMENTS

| | | | | |
|---|---|---|---|---|
| 6,980,179 | B2 | 12/2005 | Yatsuda et al. | |
| 7,095,173 | B2 | 8/2006 | Kwon et al. | |
| 7,116,047 | B2 * | 10/2006 | Kim et al. | 313/584 |
| 7,394,197 | B2 * | 7/2008 | Song | 313/582 |
| 2004/0232843 | A1 | 11/2004 | Kim et al. | |

FOREIGN PATENT DOCUMENTS

| | | | |
|---|---|---|---|
| KR | 2002020310 | A * | 3/2002 |
| KR | 10-2004-0088756 | | 10/2004 |

OTHER PUBLICATIONS

KR 2002-020310 English translation.*

* cited by examiner

DISPLAY PANEL ELECTRODE HAVING A PROTRUSION

CROSS-REFERENCE TO RELATED APPLICATIONS

This application is a continuation of prior application Ser. No. 10/942,049, filed on Sep. 16, 2004, and claims priority to and the benefit of Korean Patent Application No. 2003-66507, filed on Sep. 25, 2003, which are both hereby incorporated by reference for all purposes as if fully set forth herein.

BACKGROUND OF THE INVENTION

1. Field of the Invention

The present invention relates to a display panel, and more particularly, to a display panel in which shapes of address electrodes may be improved to prevent cross-talk.

2. Discussion of the Related Art

Plasma display panels (PDP) are generally referred to as flat display devices. In a typical PDP, a discharge gas is injected between two substrates on which a plurality of electrodes are formed, the two substrates are sealed, and a discharge voltage is applied to the substrates. When the discharge gas radiates between two electrodes, a proper pulse voltage is applied to the two electrodes to perform addressing in a place where the two electrodes cross. The discharge gas is excited to produce ultraviolet light, which in turn excites a fluorescent layer thereby producing visible images.

Such a PDP may be a direct current (DC) PDP or an alternating current (AC) PDP, depending upon the drive voltage that is applied to a discharge cell. Depending upon discharge cell electrode structure, PDPs may also be classified as a face discharge type and a surface discharge type.

With a DC PDP, all electrodes are exposed to a discharge space and electric charges directly move between facing electrodes. With an AC PDP, at least one electrode is covered with a dielectric layer so that instead of directly moving electric charges between facing electrodes, ions and electrons generated due to a discharge produce a wall voltage by sticking to the dielectric layer's surface, and the discharge is sustained by a sustaining voltage.

In a face discharge type PDP, an address electrode faces a scan electrode in each unit pixel, and addressing and sustaining discharges occur between them. In a surface discharge type PDP, an address electrode and a sustaining electrode are prepared in each unit pixel to cause addressing and sustaining discharges.

FIG. 1 shows a unit cell of a conventional PDP 10. Referring to FIG. 1, the conventional PDP 10 includes a front substrate 11 and a rear substrate 15 facing the front substrate 11. A pair of sustaining electrodes 12 are formed on the front substrate 11 to predetermined width and height, a front dielectric layer 13 is formed on the sustaining electrodes 12 using a printing method, and a protection layer 14 is formed on the front dielectric layer 13.

An address electrode 16 is formed on the rear substrate 15 to predetermined width and height, and a rear dielectric layer 27 is formed on the address electrode 16. Barrier ribs 18 are disposed on the rear dielectric layer 17 to prevent cross-talk from occurring between adjacent discharge cells. Red, green, and blue fluorescent layers 19 are formed on an upper surface of the rear dielectric layer 17 and on inner walls of the barrier ribs 18.

An inert gas is injected into a space between the front and rear substrates 11 and 15 to form a discharge area 100.

The operation of the conventional PDP 10 having the above-described structure will now be described in brief.

When a drive voltage is applied to the sustaining electrodes 12, a surface discharge occurs from the front dielectric layer 13 and the discharge area 100 on the protection layer 14. The discharge produces ultraviolet rays that excite the red, green, and blue fluorescent layers 19 to achieve a color display.

In other words, the drive voltage accelerates the discharge cell space charges, which collide with a pressurized penning gas comprised of an inert gas such as neon (Ne) mixed with helium (He), xenon (Xe), or other like gases.

As a result, the inert gas produces ultraviolet rays of 147 nanometers, which then collide with the red, green, and blue fluorescent layers 19 to produce visible rays.

FIG. 2 shows an electrode structure according to the prior art. Referring to FIG. 2, X and Y electrodes 21 and 22 are alternately arranged in a stripe shape on the front substrate 11 of FIG. 1. Address electrodes 23 are arranged in a stripe shape, on the rear substrate 15 of FIG. 1, orthogonally to the X and Y electrodes 21 and 22. Barrier ribs 24 disposed between the address electrodes 23 define discharge spaces.

However, since these conventional electrodes have wide widths, they cause high power consumption when representing low gray scale or actual moving pictures. Thus, prominent electrodes have been suggested to solve these problems.

FIG. 3 shows a layout of prominent electrodes according to the prior art. Referring to FIG. 3, X and Y electrodes 31 and 32 are alternately arranged in a stripe shape on the front substrate 11. Address electrodes 33 are arranged in a stripe shape, on the rear substrate 15 of FIG. 3, orthogonally to the X and Y electrodes 31 and 32. Barrier ribs 34 are formed between the address electrodes 33. Prominent electrodes 35 are formed at portions of the address electrodes 33 that cross with the Y electrodes 32 so as to provide a suitable electrode area for stable address discharging. The prominent electrodes 35 protrude from sidewalls of the address electrodes 33 to a predetermined width.

The electrode structure of FIG. 3 is an asymmetric structure in which a width $W_3$ of an area B coated with a blue fluorescent layer is wider than widths $W_1$ and $W_2$ of areas R and G coated with red arid green fluorescent layers. Thus, a sufficient gap may exist between the address electrode 33G and the address electrode 33B. As a result, the address electrodes 33G and 33B may be prevented from interfering with electric charge characteristics of the green and blue fluorescent layers.

However, a sufficient gap may not exist between the address electrode 33R and the address electrode 33G, which may affect an electric field between them. In this case, external factors may easily affect the wall charges of the address electrodes 33, which may result in undesired cross-talk.

FIG. 4 shows a second layout of prominent electrodes according to the prior art. Referring to FIG. 4, a width $W_6$ of an area B coated with a blue fluorescent layer has the same size as widths $W_4$ and $W_5$ of areas R and G coated with red and green fluorescent layers. Prominent electrodes 45 are formed at portions of address electrodes 43 that cross with Y electrodes 42. Similar to FIG. 2 and FIG. 3, the X and Y electrodes 41 and 42 are alternately arranged in a stripe shape.

In this case, a sufficient gap may not exist between an address electrode 43G and an address electrode 43B. Thus, although a bather rib 44 is disposed between the address electrodes 43G and 43B, they may affect an electric field distribution according to electric charge characteristics of the green and blue fluorescent layers.

SUMMARY OF THE INVENTION

Accordingly, the present invention is directed to a plasma display panel that substantially obviates one or more of the problems due to limitations and disadvantages of the related art.

The present invention provides an improved PDP in which arrangement gaps of prominent electrodes may vary so as to reduce power consumption and achieve a suitable discharge.

Additional features of the invention will be set forth in the description which follows, and in part will be apparent from the description, or may be learned by practice of the invention.

The present invention discloses a display panel, comprising a plurality of first electrodes and a plurality of second electrodes; wherein the first electrodes and the second electrodes cross at a discharge space. Prominent electrodes are formed at a portion of the first electrodes where the first electrodes cross the second electrodes, and vertical centers of the prominent electrodes are asymmetrical with respect to vertical centers of the discharge spaces.

The present invention also discloses a display panel, comprising a plurality of first electrodes and a plurality of second electrodes; wherein the first electrodes and the second electrodes cross at a discharge space; wherein prominent electrodes are formed on sidewalls of portions of the first electrodes that cross with the second electrodes, and vertical centers of the prominent electrodes being arranged at different distances from vertical centers of the discharge spaces.

The present invention also discloses a display panel, comprising a plurality of first electrodes and a plurality of second electrodes; wherein the first electrodes and the second electrodes cross at a discharge space; and prominent electrodes which are formed on sidewalls of portions of the first electrodes that cross with the second electrodes, vertical centers of the prominent electrodes being arranged at different distances from vertical centers of the discharge spaces, the prominent electrodes protruding from opposite sidewalls of the first electrodes that are arranged in adjacent discharge spaces according to electric charge characteristics of adjacent fluorescent layers.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Hereinafter, exemplary embodiments of the present invention will be described in detail with reference to the attached drawings.

Figure 1:
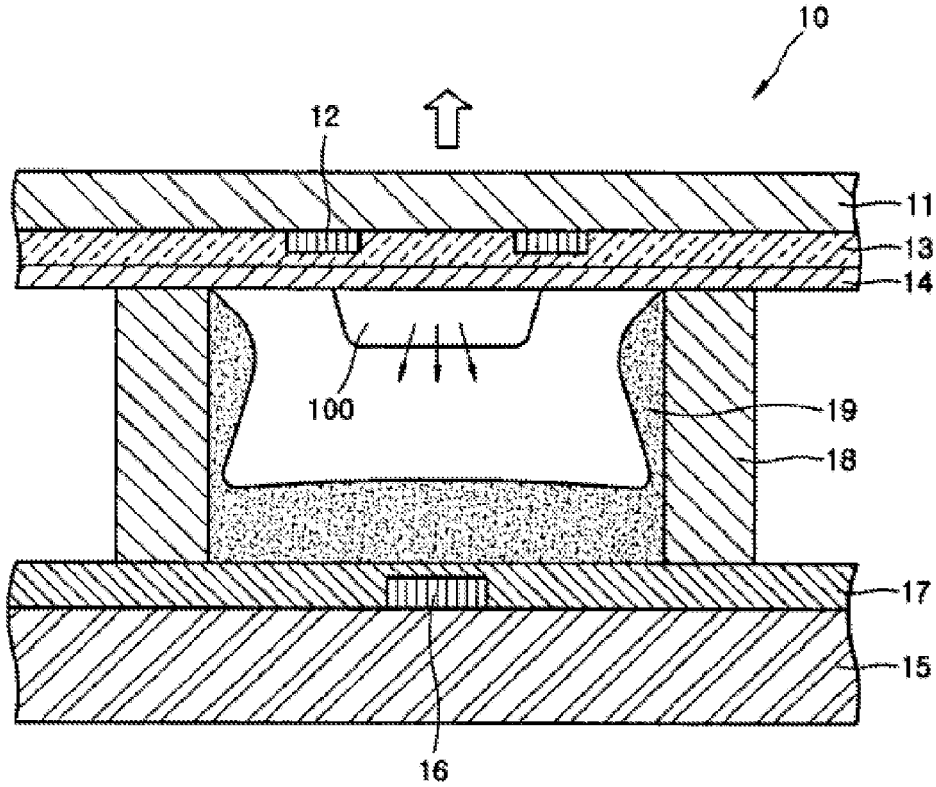
FIG. 1 (PRIOR ART)
FIG. 1 shows a unit cell of a conventional PDP.
Figure 2:
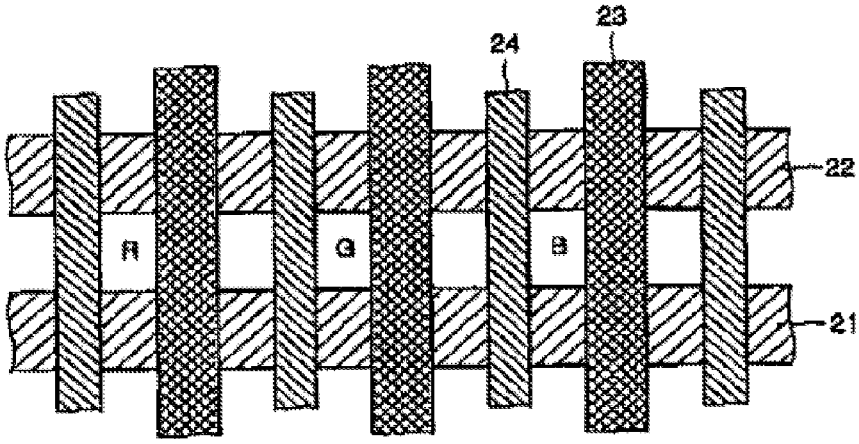
FIG. 2 (PRIOR ART)
FIG. 2 shows a PDP electrode arrangement according to the prior art.
Figure 3:
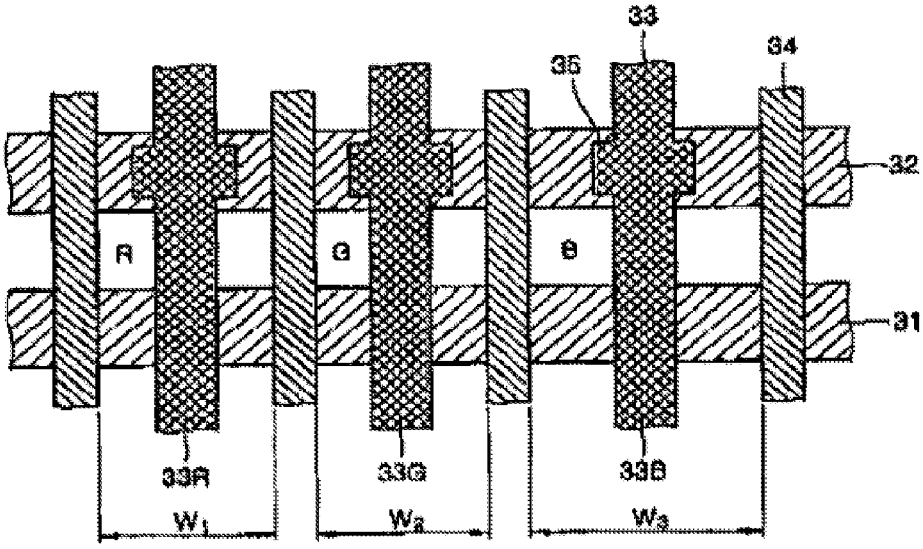
FIG. 3 (PRIOR ART)
FIG. 3 shows a PDP electrode arrangement according to the prior art.
Figure 4:
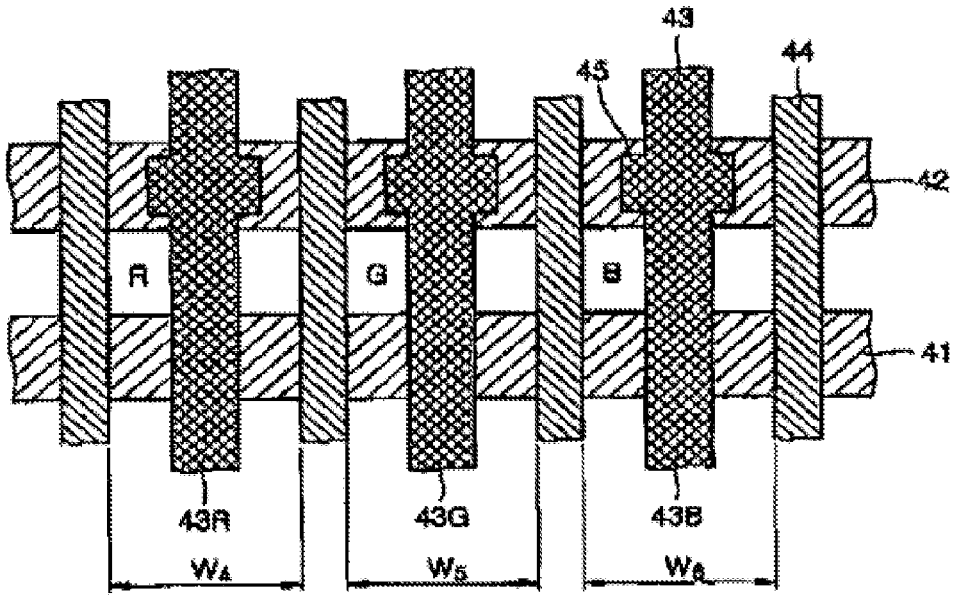
FIG. 4 (PRIOR ART)
FIG. 4 shows a PDP electrode arrangement according to the prior art.
Figure 5:
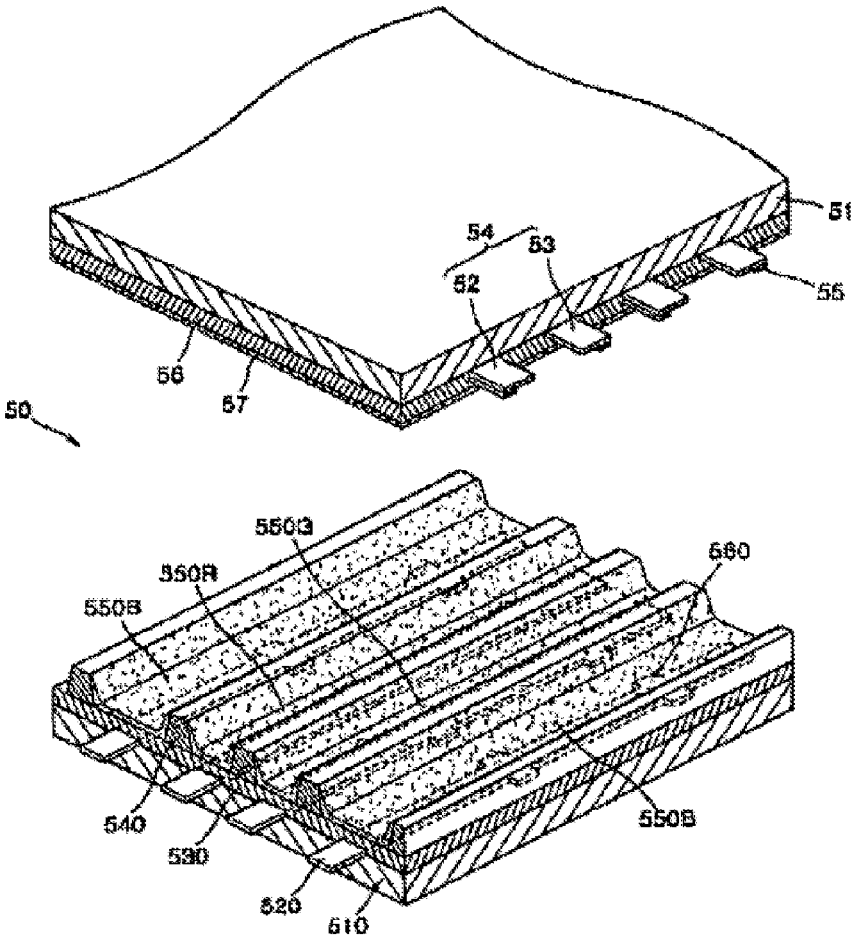
FIG. 5 shows a PDP according to an exemplary embodiment of the present invention.

FIG. 5 is an exploded perspective view of a portion of a PDP 50. Referring to FIG. 5, the PDP 50 includes a front substrate 51 and a rear substrate 510 facing the front substrate 51.

X and Y electrodes 52 and 53 are alternately arranged as sustaining electrodes 54 at predetermined distances on a lower surface of the front substrate 51. Discharge spaces are formed between the X and Y electrodes 52 and 53. The X and Y electrodes 52 and 53 have a stripe shape, and may be formed of transparent conductive layers. Bus electrodes 55 are formed on lower surfaces of the X and Y electrodes 52 and 53 to reduce a line resistance of the sustaining electrodes 54.

An area between a pair of adjacent sustaining electrodes 54 corresponds to a non-discharge area, where a black matrix layer may be formed to improve the PDP's contrast.

A front dielectric layer 56 formed on the front substrate 51 covers the sustaining electrodes 54 and the bus electrodes 55. A protection layer 57, which may be made of magnesium oxide, covers the front dielectric layer 56.

Address electrodes 520 are formed at predetermined distances on an upper surface of the rear substrate 510, and they are arranged orthogonally to the X and Y electrodes 52 and 53. A rear dielectric layer 530 covers the address electrodes 520. Barrier ribs 540 formed on an upper surface of the rear dielectric layer 530 define discharge spaces and may prevent cross-talk. The bather ribs 540 are arranged parallel with the address electrodes 520. Red, green, and blue fluorescent layers 550R, 550G, and 550B are formed on inner walls of the barrier ribs 540 and the upper surface of the rear dielectric layer 530 to fill the discharge spaces.

Here, the red, green, and blue fluorescent layers 550R, 550G, and 550B coat the discharge spaces, which may have different brightness and size. In other words, the discharge space that is coated with the blue fluorescent layer 550B has a relatively lower brightness and is wider than the discharge spaces that are coated with the red and green fluorescent layers 550R and 550G. Thus, in this exemplary embodiment of the present invention, the discharge spaces are asymmetric.

An exemplary embodiment of the present invention has prominent electrodes 560 that protrude from the address electrodes 520 to different sizes and at different distances in the discharge spaces which are coated with the red, green, and blue fluorescent layers 550R, 550G, and 550B, and vertical centers of the prominent electrodes 560 are not arranged at equal distances from vertical centers of the discharge spaces.

Figure 6:
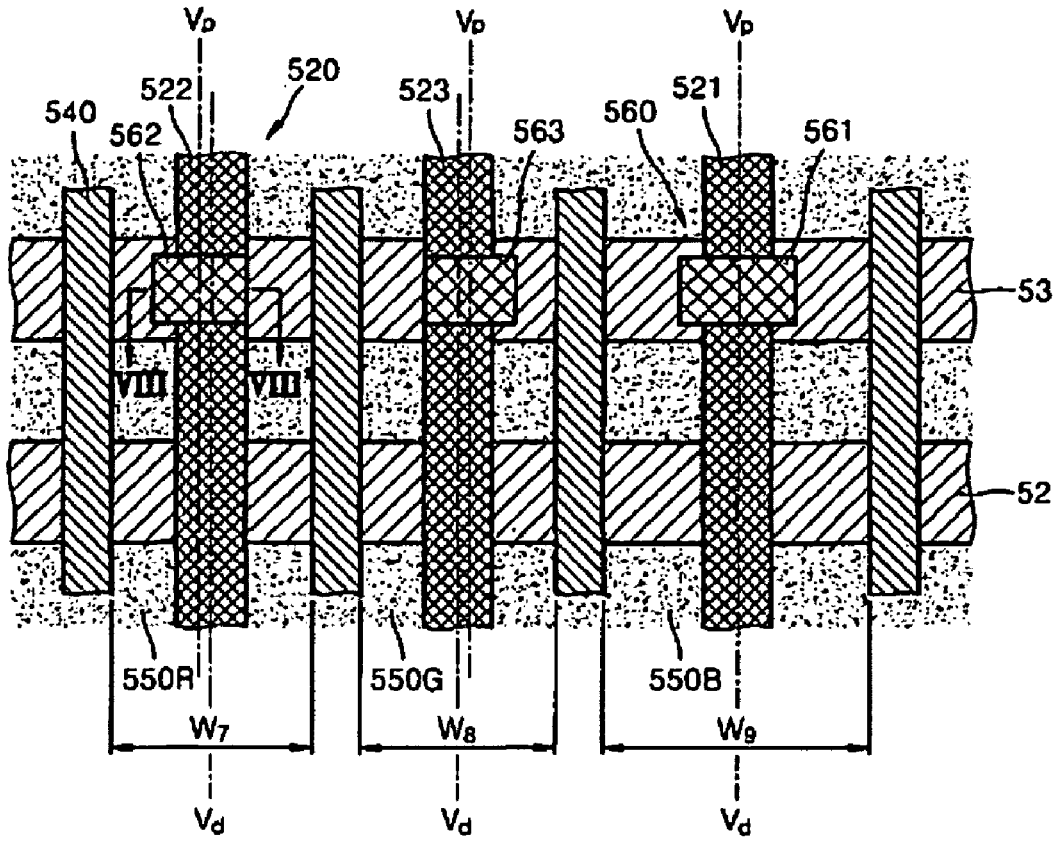
FIG. 6 shows an electrode arrangement, according to an exemplary embodiment of the present invention, for the PDP of FIG. 5.

FIG. 6 is a schematic view of the arrangement of the address electrodes 520, the barrier ribs 540, the X and Y electrodes 52 and 53, and red, green, and blue fluorescent layers 550R, 550G, and 550B of FIG. 5, as discussed above.

Referring to FIG. 6, a width $W_9$ of an area which is coated with the blue fluorescent layer 550B is wider than widths $W_7$ and $W_8$ of areas which are coated with the red and green fluorescent layers 550R and 550G. In other words, the discharge space which is coated with the blue fluorescent layer 550B is wider than the discharge spaces which are coated with the red and green fluorescent layers 550R and 550G.

Figure 8A:
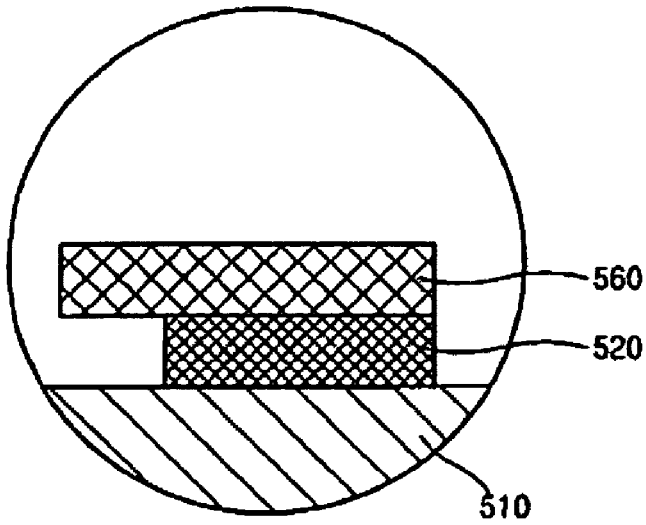
FIG. 8A and FIG. 8B are cross-sectional views along line VIII-VIII' of FIG. 6.
Figure 8B:
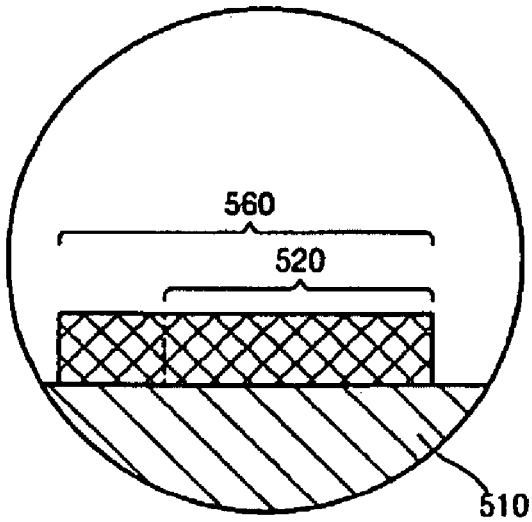

Here, an address discharge occurs between the address electrodes 520 and the Y electrodes 53. Thus, the prominent electrodes 560 are formed at the address electrodes 520 to provide a suitable electrode area for stable address discharging. The prominent electrodes 560 may be formed as a separate layer on top of the address electrodes 520, as shown in FIG. 8A. Preferably, the prominent electrodes 560 are formed coplanar with the address electrodes 520, as shown in FIG. 8B. The prominent electrodes 560 are arranged differently in the areas coated with red, green, and blue fluorescent layers 550R, 550G, and 550B.

Specifically, prominent electrodes 561 are symmetrically formed on both sidewalls of the address electrode 521. In other words, the prominent electrodes 561 are formed by the left and right sidewalls of a vertical axis along which the address electrode 521 is arranged, so as to have the same area.

A prominent electrode 562 is asymmetrically formed in that it is only on one sidewall of an address electrode 522 in the area which is coated with the red fluorescent layer 550R. A prominent electrode 563 is asymmetrically formed in that it is only on one sidewall of an address electrode 523 in the area which is coated with the green fluorescent layer 550G.

The prominent electrode 562 protrudes from the left sidewall of the address electrode 522, in an opposite direction to the address electrode 523. The prominent electrode 562 does not protrude from the right sidewall of the address electrode 522 that faces the address electrode 523.

The prominent electrode 563 protrudes from a sidewall of the address electrode 523, in an opposite direction to the address electrode 522. The prominent electrode 563 does not protrude from a sidewall of the address electrode 523 that faces the address electrode 522.

To summarize, the prominent electrode 562 protrudes from the left sidewall of the address electrode 522, and the prominent electrode 563 protrudes from the right sidewall of the address electrode 523. In other words, the prominent electrodes 562 and 563 protrude from only one sidewall of the left and right sidewalls of vertical axes along which the address electrodes 522 and 523 are arranged. Thus, a sufficient gap may be maintained between the prominent electrodes 562 and 563.

As a result, vertical centers of the prominent electrodes $V_p$ are not arranged at equal distances from the vertical centers of the discharge spaces $V_d$ which are coated with the red, green, and blue fluorescent layers 550R, 550G, and 550B.

In the PDP 50 having the above-described structure, a voltage may be applied between the Y electrodes 53 and the address electrodes 520 to cause a preliminary discharge that charges wall charges. In this state, a voltage may be applied between the X and Y electrodes 52 and 53 to cause a sustaining discharge that produces plasma.

Ultraviolet rays radiate from the plasma to excite the red, green, and blue fluorescent layers 550R, 550G, and 550B so as to realize an image.

Here, the prominent electrodes 562 and 563 are arranged on different sides of address electrodes 522 and 523, respectively, which are arranged in relatively narrow discharge spaces. Thus, the prominent electrodes 562 and 563 contribute to securing the electrode area suitable for the stable address discharge and the sufficient gap therebetween. As a result, crosstalk may be prevented.

Figure 7:
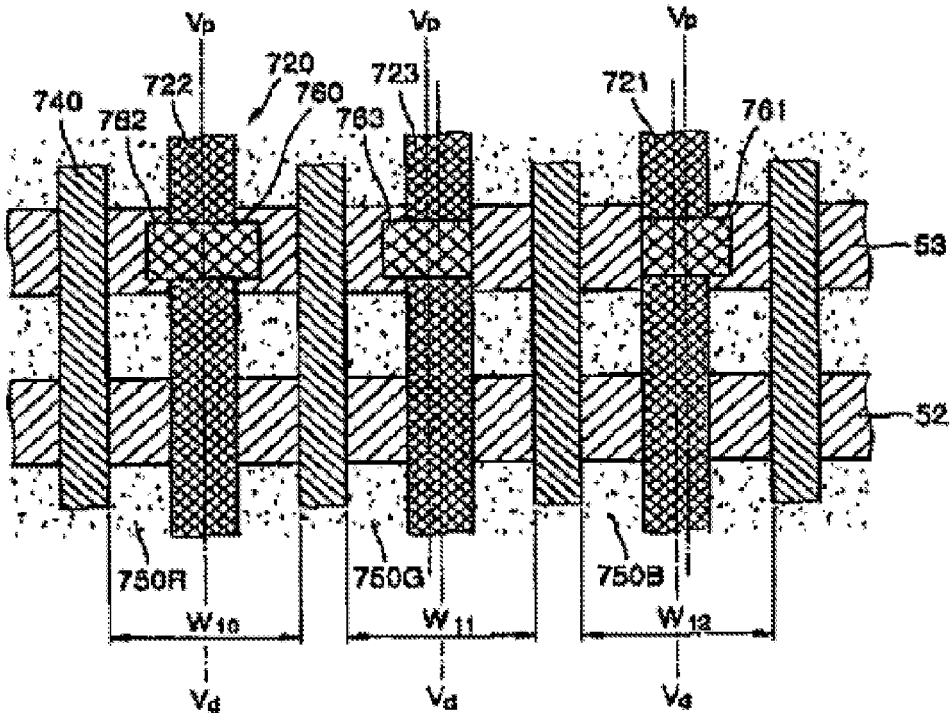
FIG. 7 shows an electrode arrangement according to a second exemplary embodiment of the present invention.

FIG. 7 is a schematic view for showing the arrangement of electrodes and barrier ribs according to a second exemplary embodiment of the present invention. Referring to FIG. 7, the X and Y electrodes 52 and 53 are alternately arranged at predetermined distances on the front substrate 51 of FIG. 5. Address electrodes 720 are arranged on the rear substrate 510 orthogonally to the X and Y electrodes 52 and 53. Barrier ribs 740 are installed between adjacent address electrodes 720.

The barrier ribs 740 define discharge spaces that are coated with red, green, and blue fluorescent layers 750R, 750G, and 750B. Unlike the previous exemplary embodiment, widths $W_{10}$, $W_{11}$, and $W_{12}$ of areas which are coated with the red, green, and blue fluorescent layers 750R, 750G, and 750B, are the same so that the discharge spaces are symmetrical.

Prominent electrodes 760 are formed at the address electrodes 720 to secure the electrode area suitable for a stable address discharge. The prominent electrodes 760 protrude from sidewalls of the address electrodes 720 where the address electrodes 720 cross with the Y electrodes 53.

Although the barrier ribs 740 are positioned between the discharge spaces, the address electrodes 720 may affect a mutual electric field distribution due to the electric charge characteristics of the red, green, and blue fluorescent layers 750R, 750G, and 750B, In other words, wall charges of an address electrode 721 in the area that is coated with the blue fluorescent layer 750B and an address electrode 723 in the area that is coated with the green fluorescent layer 750G may be easily affected by external factors, which may cause cross-talk.

In order to prevent cross-talk, the prominent electrode 761 may be asymmetrically formed on a sidewall of the address electrode 721, and the prominent electrode 763 may be asymmetrically formed on a sidewall of the address electrode 723.

In other words, the prominent electrode 761 protrudes from the right sidewall only of the address electrode 721, and the prominent electrode 763 protrudes from the left sidewall only of the address electrode 723.

The prominent electrodes 761 and 763 are not formed on sidewalls of the address electrodes 721 and 723 that face each other.

The prominent electrodes 761 and 763 may contribute to securing an electrode area suitable for the address discharge and a sufficient gap between the address electrodes 721 and 723. As a result, the address electrodes 721 and 723 may not affect a mutual electric field distribution, which would result in preventing cross-talk.

Comparing the address electrodes 721 and 723 in the areas which are coated with the green and blue fluorescent layers 750G and 750B with an address electrode 722 in the area which is coated with the red fluorescent layer 750R, electric charges of the red, green, and blue fluorescent layers 750R, 750G, and 750B are stable enough that they may not interfere with one another. As a result, the address electrodes 721, 722, and 723 may not affect a mutual electric field distribution.

In this case, prominent electrodes 762 are symmetrically formed on both sidewalls of the address electrode 722. The prominent electrodes 762 are formed by the left and right sidewalls of a vertical axis along which the address electrode 722 is arranged, so as to have the same area.

As described above, in a PDP according to exemplary embodiments of the present invention, prominent electrodes may be formed at portions of address electrodes that cross with Y electrodes, so that a stable address discharge may occur. The prominent electrodes may contribute to securing sufficient gaps among the address electrodes, which may be arranged under red, green, and blue fluorescent layers, so as to prevent cross-talk and improve a margin of a drive voltage.

Exemplary embodiments of the present invention discussed above refer to quadrangular shaped prominent electrodes. The present invention is not limited, however, to such shapes. For example, prominent electrodes may be shaped as half-circles, or the quadrangular shapes may have rounded corners. Consequently, prominent electrodes on adjacent address electrodes need not be the same shape.

While exemplary embodiments of the present invention have been described with reference to an AC PDP, the present invention is not limited to an AC PDP. It may be applicable to any display device that includes an electrode structure in which a panel displays images by the mutual drive of electrodes placed on facing substrates such as DC PDPs, electroluminescence displays (ELD), liquid crystal displays (LCD), and field emission displays (FED).

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display panel, comprising:

a plurality of barrier ribs defining discharge spaces;

a plurality of first electrodes extended in a first longitudinal direction; and a plurality of second electrodes extended so as to cross the plurality of first electrodes, wherein at least two first electrodes each comprise a first electrode part continuously formed in the first longitudinal direction and a second electrode part protruded from only one side of the first electrode part so as to cross the first longitudinal direction, and the second electrode parts of the at least two first electrodes protrude from the first electrode parts in opposite directions from each other, and wherein the first electrodes are address electrodes.

2. The display panel of claim 1, wherein the second electrode part is formed in a region in which the first electrode and the second electrode cross each other.

3. The display panel of claim 2, wherein the second electrode part is stacked on the first electrode part.

4. The display panel of claim 1, wherein the discharge spaces comprise a first discharge space having a first width, a second discharge space having a second width, and a third discharge space having a third width, and wherein the third width is larger than the first width and the second width.

5. The display panel of claim 4, wherein one of the at least two first electrodes is arranged in the first discharge space, and the other of the at least two first electrodes is arranged in the second discharge space.

6. The display panel of claim 5, wherein a third first electrode comprises the first electrode part continuously formed in the first longitudinal direction and the second electrode part protruded from both sides of the first electrode part so as to cross the first longitudinal direction, the third first electrode being arranged in the third discharge space.

7. The display panel of claim 4, wherein different type phosphors are coated in the first discharge space, the second discharge space, and the third discharge space.

8. The display panel of claim 6, wherein ends of the second electrode part of the third first electrode in the third discharge space are symmetrically protruded with respect to the first electrode part.

9. The display panel of claim 5, wherein the third discharge space is arranged between the first discharge space and the second discharge space, and wherein the second electrode parts of the first electrodes, which are respectively arranged in the first discharge space and the second discharge space, are protruded toward the third discharge space.

10. The display panel of claim 4, wherein the first electrodes, each of which having the first electrode part and the second electrode part, are arranged in the first discharge space and the second discharge space, wherein the second electrode parts in the first discharge space and the second discharge space are respectively protruded so as to be opposite to each other.

* * * * *